US007444701B2

(12) United States Patent
Ashley

(10) Patent No.: US 7,444,701 B2
(45) Date of Patent: Nov. 4, 2008

(54) ELASTIC FITTED DISPOSABLE DIAPER CHANGING PAD

(76) Inventor: Mary B. Ashley, 6424 Felton Ct., Charlotte, NC (US) 28277

( * ) Notice: Subject to any disclaimer, the term of this patent is extended or adjusted under 35 U.S.C. 154(b) by 34 days.

(21) Appl. No.: 11/382,198

(22) Filed: May 8, 2006

(65) Prior Publication Data

US 2007/0256244 A1 Nov. 8, 2007

(51) Int. Cl.
*A37C 31/00* (2006.01)

(52) U.S. Cl. ..... 5/655; 5/947

(58) Field of Classification Search ..... 5/655, 5/947, 417, 420

See application file for complete search history.

(56) References Cited

U.S. PATENT DOCUMENTS 6,327,726 B1 12/2001 Weber
6,428,098 B1 * 8/2002 Allbaugh ..... 297/219.12
6,883,193 B2 4/2005 Brooks et al.
2001/0033914 A1 10/2001 Walker et al.

OTHER PUBLICATIONS

Inventive Parent, Changing Table Topper, [online], [retrieved on Feb. 10, 2006], Retrieved from: www.inventiveparent.com.

* cited by examiner

*Primary Examiner*—Fredrick Conley
(74) *Attorney, Agent, or Firm*—Ashley Law Firm P.C.; Stephen S. Ashley, Jr.

(57) ABSTRACT

A disposable diaper changing pad for positioning on a supporting structure such as a diaper changing table provides a barrier between the diaper changing table and a child positioned on the top surface of the pad. The changing pad includes a liquid absorbent material and a latent elasticity formed in the pad proximate a peripheral edge of the pad. The pad can be stretched over a top surface of the table and contract against the table so that the pad maintains complete coverage over the top surface of the changing table. The latent elasticity can be provided by an elastic band positioned within the pad.

17 Claims, 5 Drawing Sheets

Fig. 1
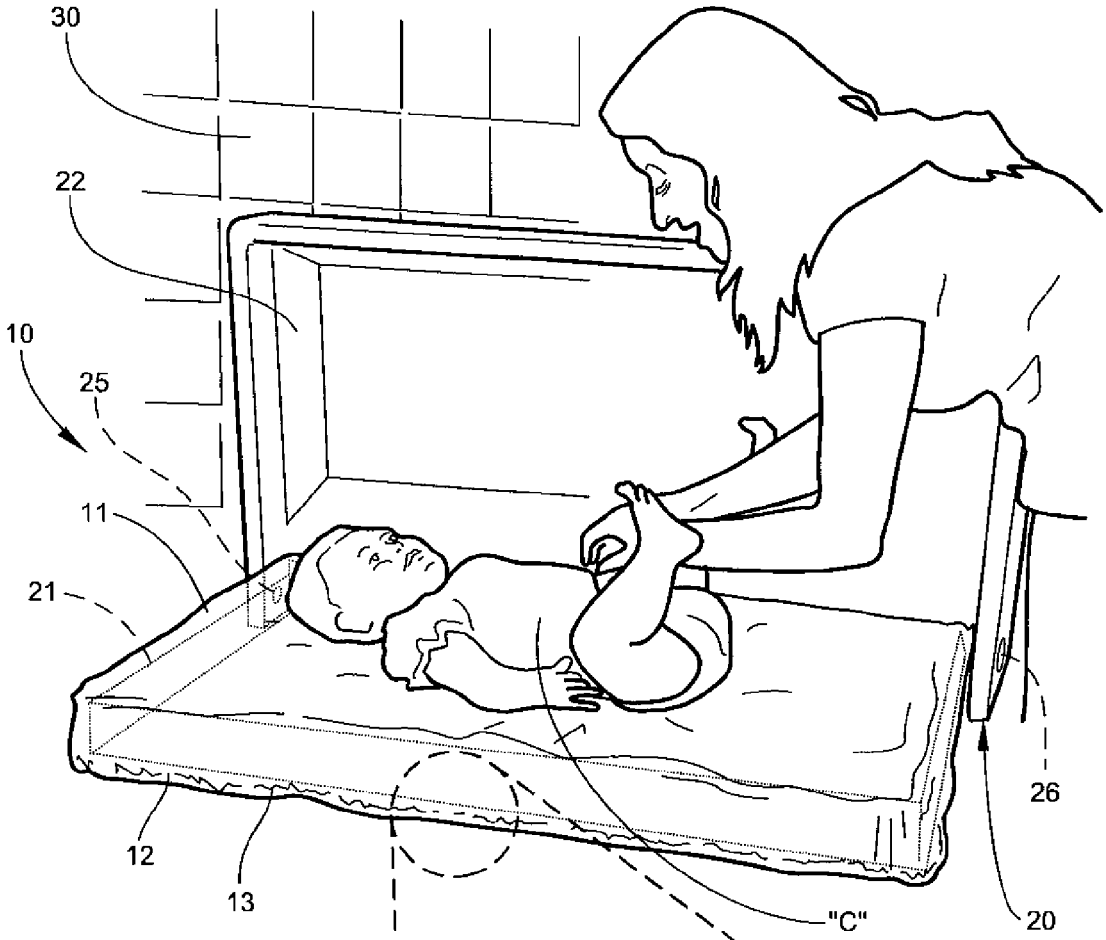
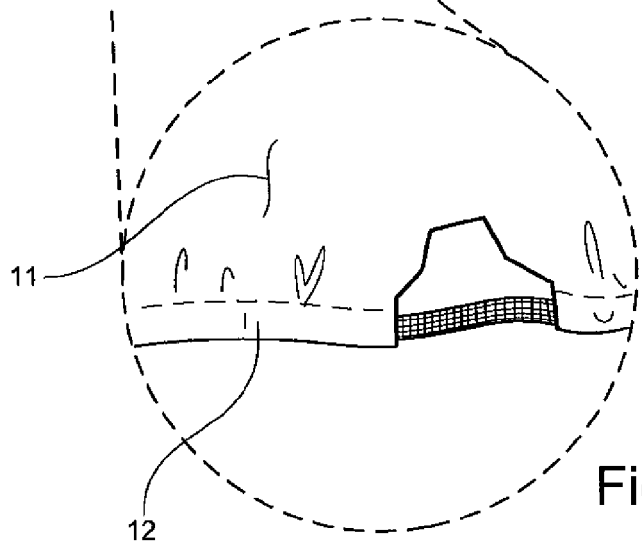
Fig. 1A

ELASTIC FITTED DISPOSABLE DIAPER CHANGING PAD

TECHNICAL FIELD AND BACKGROUND OF THE INVENTION

The invention relates to a disposable absorbent pad for aiding in the changing of a person's diapers or the performance of some other task in which it is desirable to keep the area clean and dry. The invention is particularly useful in changing a child or infant's diapers on a public diaper changing station.

Diaper changing stations provide a convenient platform for changing a child's diapers, and are common today in public restroom facilities. Typically, the stations comprise a table that is mounted to the restroom wall. The table can be mounted such that it is pivotable from a storage position in which it is adjacent and generally parallel to the wall, and a changing position in which it extends outwardly from and generally perpendicular to the wall.

While diaper changing stations in public restrooms offer convenience, a common concern regarding their use is the accumulation of germs, bacteria and other pathogens at the stations from multiple users, and the spread of such pathogens from user to user. Diaper changing, by its very nature, is a dirty activity that will result in the presence of pathogens. In addition, such changing stations are often in public facilities that are not cleaned frequently or thoroughly. Furthermore, the user often does not have the time or materials necessary for cleaning the changing station. Accordingly, it is desirable to have a means for quickly providing a clean and safe area on which to change the diaper of a child at a public changing station.

Diaper changing pads have been used to cover the top of the changing station table to provide a relatively clean surface for changing the child's diaper. However, such pads do not have a means for securely attaching to the changing station table. In addition, such pads often do not completely cover the table as the shape and size of tables vary and the pads cannot conform therewith. Children having their diaper changed often move around unpredictably while on the changing table. As such, the unattached changing pad does not maintain its position on the table, thereby exposing parts of the contaminated table surface to contact the child. The present invention was conceived to overcome the aforementioned problems.

SUMMARY OF THE INVENTION

Therefore, it is an object of the present invention to provide a means for maintaining a sanitary surface on a diaper changing station table.

It is another object of the invention to provide a diaper changing pad that can be easily positioned on a diaper changing station table, and can conform to tables of various shapes and sizes.

It is yet another object of the invention to provide a diaper changing that completely covers the top surface of a diaper changing station table, and maintains complete coverage despite movement by the child being changed.

These and other objects of the present invention are achieved in the preferred embodiments disclosed below by providing a disposable diaper changing pad for positioning on a supporting structure to provide a barrier between the supporting structure and a person positioned on the top surface of the pad. The changing pad includes a liquid absorbent material and a latent elasticity formed in the pad proximate a peripheral edge of the pad. As such, the pad can be stretched over a top surface of the supporting structure and contract against the supporting structure so that the pad maintains complete coverage over the top surface of the supporting structure.

According to a preferred embodiment of the invention, the latent elasticity includes an elastic band.

According to another preferred embodiment of the invention, at least one string is connected to the peripheral edge of the pad for tying to the support structure.

According to yet another preferred embodiment of the invention, first and second pairs of strings are connected to the peripheral edge of the pad for tying to the support structure.

According to yet another preferred embodiment of the invention, the latent elasticity is formed continuously along the entire peripheral edge of the pad.

According to yet another preferred embodiment of the invention, the peripheral edge of the pad includes two points in which there is no latent elasticity.

According to yet another preferred embodiment of the invention, the supporting structure is a diaper changing table that is pivotably connected to a wall by first and second connecting members, and the peripheral edge of the pad includes first and second points in which there is no latent elasticity positioned on the peripheral edge such that the first point is proximate the first member and the second point is proximate the second member when the pad is positioned on the changing table.

According to yet another preferred embodiment of the invention, an adhesive section is positioned at the first and second points for maintaining the pad on the changing table.

According to yet another preferred embodiment of the invention, a first pair of ties is connected to the pad at the first point for tying around the first member, and a second pair of ties connected to the pad at the second point for tying around the second member.

According to yet another preferred embodiment of the invention, the pad is rectangular, and has first and second opposed longitudinal sides and first and second opposed lateral sides.

According to yet another preferred embodiment of the invention, the latent elasticity is formed in the first and second longitudinal sides, and the first lateral side.

According to yet another preferred embodiment of the invention, the second lateral side is proximate the support structure, and further comprising an adhesive positioned proximate the second lateral side.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 1 is a perspective environmental view of a disposable diaper changing pad according to a preferred embodiment of the invention;

FIG. 1A is an enlarged partial perspective view of the disposable diaper changing pad of FIG. 1;

DETAILED DESCRIPTION OF THE PREFERRED EMBODIMENTS AND BEST MODE

Figure 2:
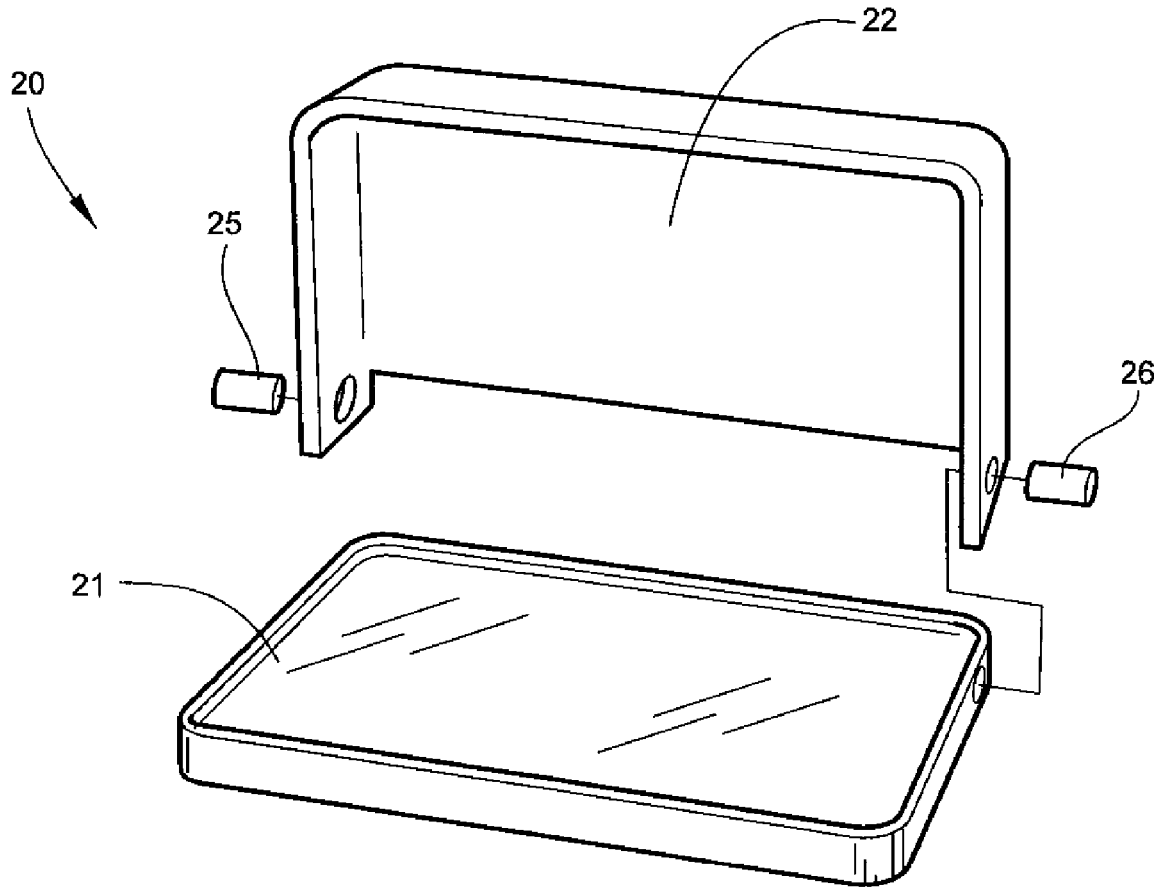
FIG. 2 is an exploded perspective view of a diaper changing table apparatus on which the diaper changing pad of FIG. 1 is adapted for use.

Referring now specifically to the drawings, an elastic fitted disposable diaper changing pad according to a preferred embodiment of the invention is illustrated in FIG. 1, and shown generally at reference numeral 10. The diaper changing pad 10 comprises an absorbent sheet having a layer of liquid absorbent material 11 and a latent elasticity formed in the peripheral edge 12 of the sheet 11. The absorbent sheet 11 preferably comprises at least two layers. The latent elasticity can be provided by an elastic band 13 positioned within the interior of the sheet 11 along the peripheral edge 12, as shown in FIG. 1A. Preferably, the elastic band 13 extends along all four sides of the pad 10, however, it is possible that the elastic band 13 is present in two or three sides. The elastic band 13 can be made of rubber, spandex and/or other elastomeric fibers. In addition, the sheet 11 can include an antimicrobial material such as MICROBAN.

Figure 3:
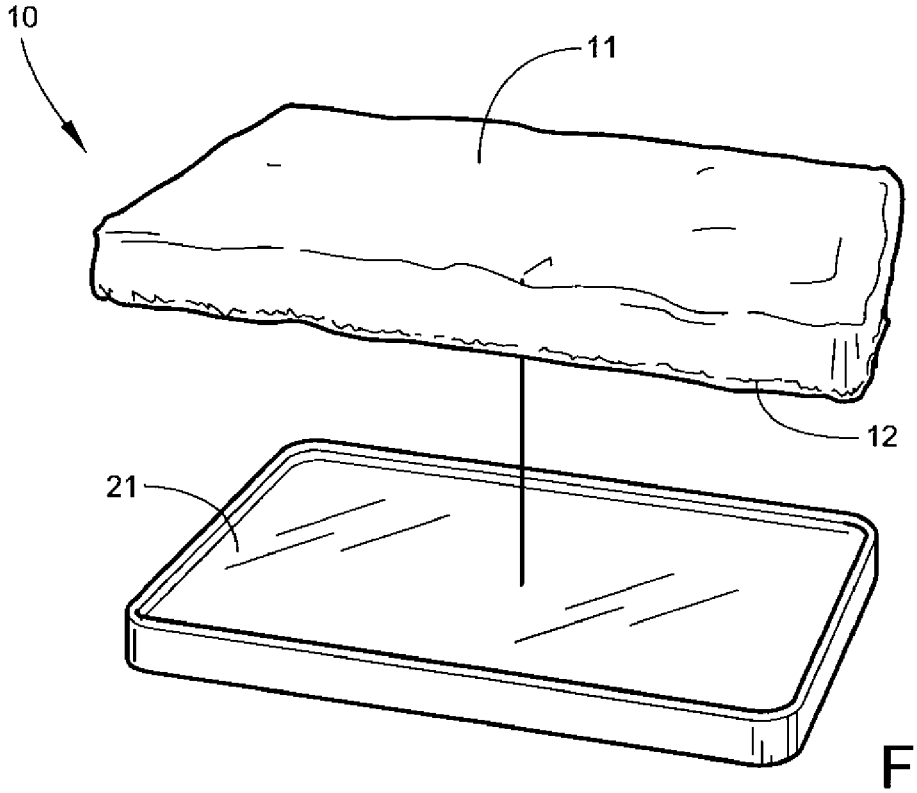
FIG. 3 is another perspective view of the diaper changing pad of FIG. 1.
Figure 4:
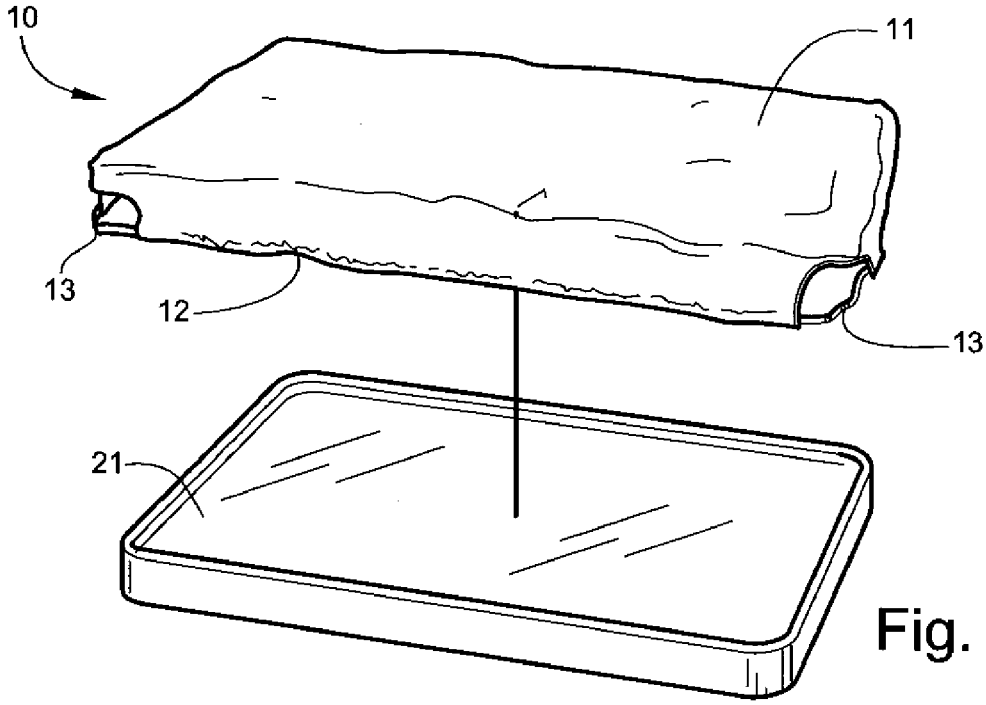
FIG. 4 is another perspective view of the diaper changing pad of FIG. 1.

As shown in FIG. 1, the pad 10 is adapted for use with a diaper changing table apparatus 20. The changing apparatus 20, shown in detail in FIG. 2, can comprise a changing table 21 pivotably mounted to a support member 22 by a pair of connecting members such as bolts 25, 26. The support member 22 is mounted on a wall 30, as shown in FIG. 1. When not in use the table 21 is pivoted upward to a storage position in which it resides within the support member 22. When a child's diaper is to be changed, the table 21 is pivoted downward so that it resides generally perpendicular to the wall 30, as shown in FIG. 1. The pad 10 is positioned over the table 21 as shown in FIGS. 1, 3 and 4. The elastic band 13 allows for the pad 10 to be stretched over and completely cover the table 21. Contraction of the elastic band 13 against the table 21 maintains the pad securely on the table 21. As such, erratic movement by the child "C" on the table 21 does not displace the pad 10 and the table 21 remains completely covered, with no area of the table 21 exposed to the child "C". The pad 10 provides a barrier between the child "C" and pathogens present on the table 21. Furthermore, the elasticity of the pad 10 allows for the pad 10 to conform to changing tables of varying shapes and sizes.

Figure 5:
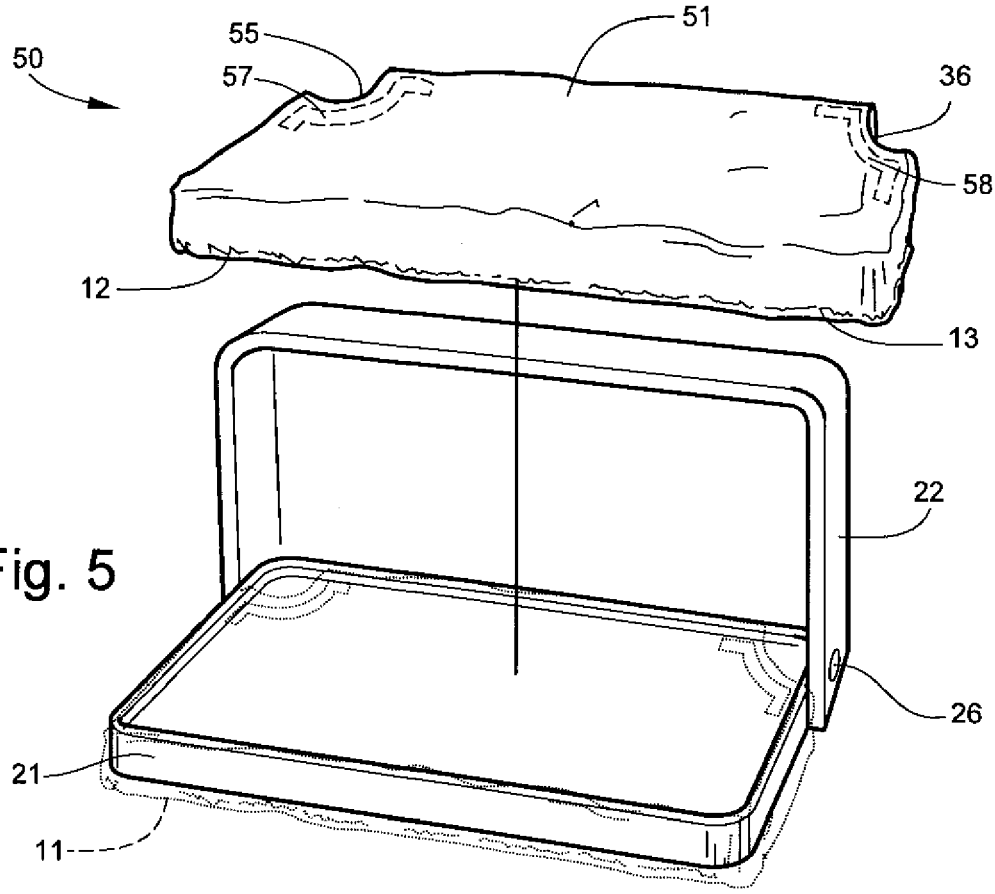
FIG. 5 is a perspective view of a disposable diaper changing pad according to another preferred embodiment of the invention.

A disposable diaper changing pad according to another preferred embodiment of the invention is illustrated in FIG. 5, and shown generally at reference numeral 50. The diaper changing pad 50 comprises an absorbent sheet 51 having a layer of liquid absorbent material and a latent elasticity formed in the peripheral edge 52 of the sheet 51. The latent elasticity can be provided by an elastic band 53 positioned within the interior of the sheet 51 along the peripheral edge 52. The pad 50 is identical to the previously described pad 10, except that the pad 50 has two cut-away corners sections 55, 56 that are proximate connecting members 25, 26 when the pad 50 is positioned on the table 21. Pad 50 is particularly suitable when the structure of the connecting members 25, 26 is such that it would be difficult to position pad 10 at those particular points of the table 21. As such, the corner sections 55, 56 of pad 50 can provide a better fit with the changing apparatus 20. In addition, adhesive sections 57, 58 can be positioned on the underside of the sheet 51 proximate the corner sections 55, 56, respectively, to secure the corner sections 55, 56 to the table 21. Alternatively, the adhesive sections can extend laterally or longitudinally along the underside of the sheet 51.

Figure 6:
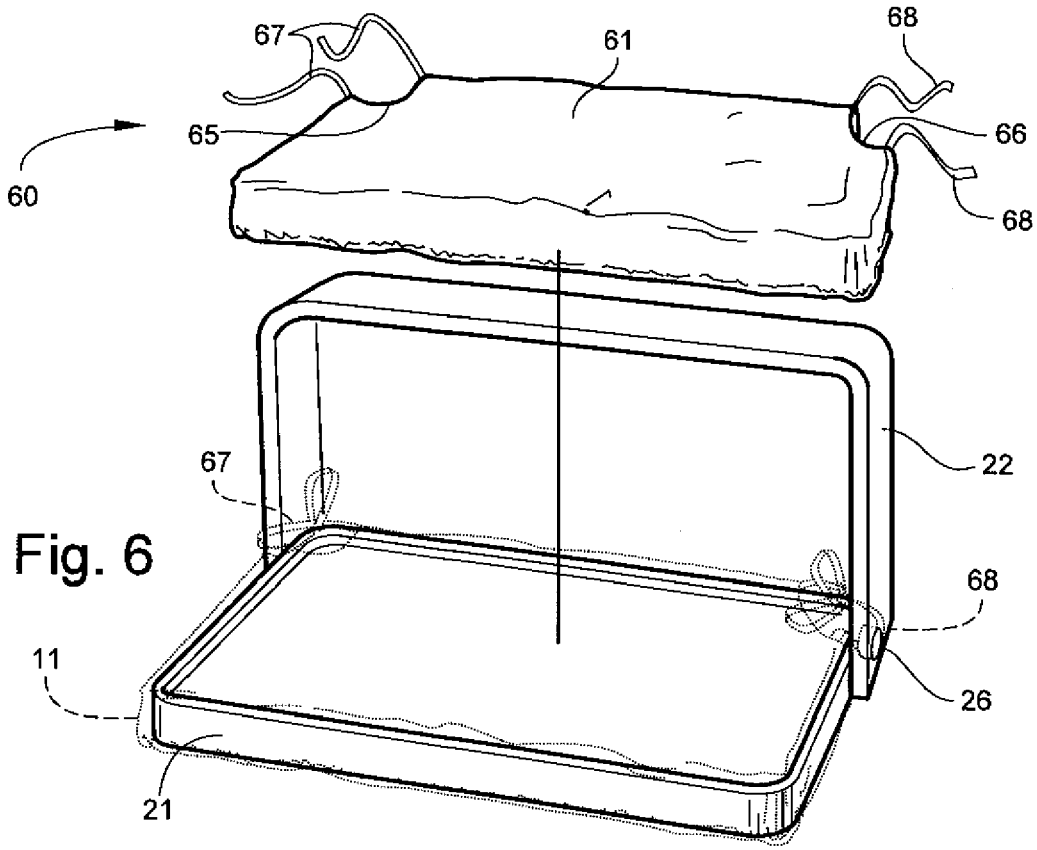
FIG. 6 is a perspective view of a disposable diaper changing pad according to yet another preferred embodiment of the invention.

A disposable diaper changing pad according to yet another preferred embodiment of the invention is illustrated in FIG. 6, and shown generally at reference numeral 60. The diaper changing pad 60 comprises an absorbent sheet 61 having a layer of liquid absorbent material and a latent elasticity formed in the peripheral edge 62 of the sheet 61. The latent elasticity can be provided by an elastic band 63 positioned within the interior of the sheet 61 along a portion of the peripheral edge 62. The pad 60 has two cut-away corners sections 65, 66 that do not have elasticity, and are proximate connecting members 25, 26 when the pad 60 is positioned on the table 21. The pad 60 is identical to the previously described pad 60, except that the pad 60 has two pairs of ties 67, 68 positioned proximate the corner sections 65, 66, respectively, and the elastic band 63 does not extend along the side of the pad that is adjacent to the support member 22 of the changing apparatus 20. As shown in FIG. 6, the ties 67, 68 are tied to the changing apparatus 20, and help maintain the pad 60 securely on the table 21.

Figure 7:
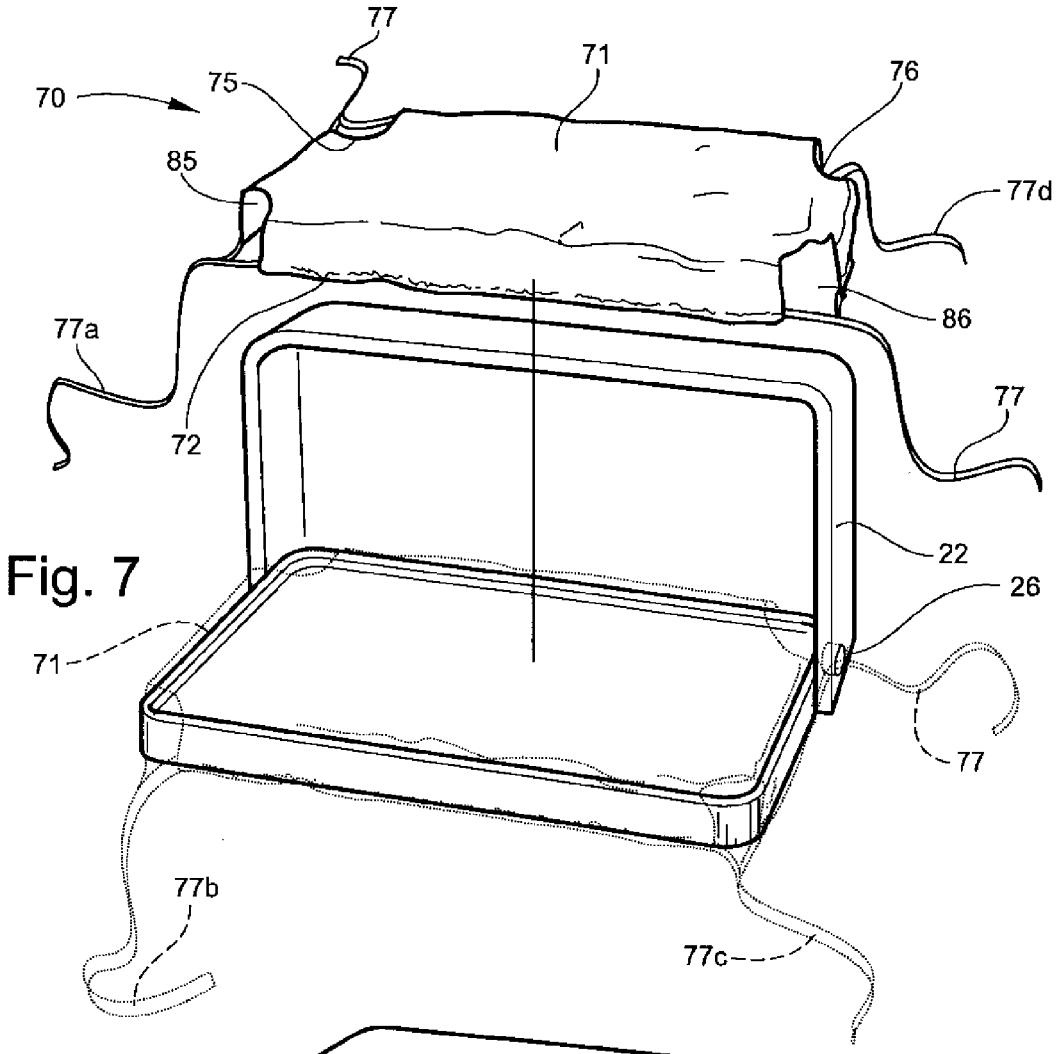
FIG. 7 is perspective view of a disposable diaper changing pad according to yet another preferred embodiment of the invention.
Figure 8:
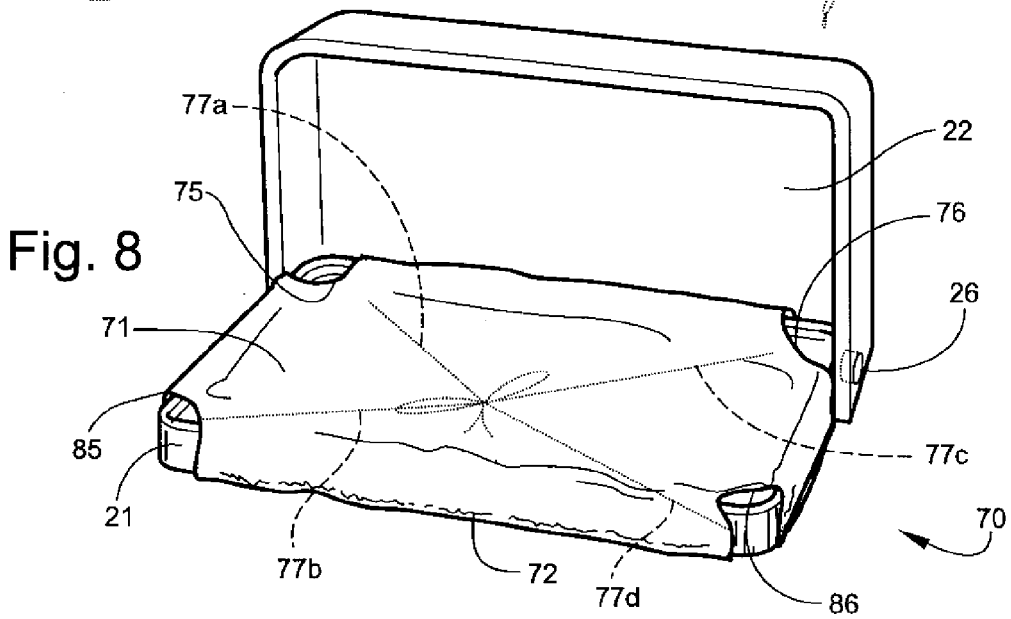
FIG. 8 is another perspective view of the diaper changing pad of FIG. 7.

A diaper changing pad according to yet another preferred embodiment of the invention is illustrated in FIG. 7, and shown generally at reference numeral 70. The diaper changing pad 70 comprises an absorbent sheet 71 having a layer of liquid absorbent material and a latent elasticity formed in the peripheral edge 72 of the sheet 71. The latent elasticity can be provided by an elastic band 73 positioned within the interior of the sheet 71 along a portion of the peripheral edge 72. The pad 70 has two cut-away corner sections 75, 76 that do not have elasticity, and are proximate connecting members 25, 26 when the pad 70 is positioned on the table 21. In addition, the pad has cut away corner sections 85, 86 opposite corner sections 75, 76. Each of the corner sections 75, 76, 85, 86 has a string 77*a*, 77*b*, 77*c*, 77*d*, attached respectively thereto. As shown in FIG. 8, the strings 77*a-d* are tied to each other under the table 21 in a diagonal configuration to secure the pad 70 to the table 21. Alternatively, the strings at each longitudinal end of the table can be tied together, such that 77*a* and 77*b* are tied together, and 77*c* and 77*d* are tied together. In yet another alternative embodiment, a peelable adhesive strip can be positioned at each corner section 75, 76, 85, 86 instead of strings 77*a-d*.

An elastic fitted disposable diaper changing pad and method of using same are described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A disposable diaper changing pad for positioning on a supporting structure to provide a barrier between the supporting structure and a person positioned on the top surface of the pad, comprising a liquid absorbent material and a latent elasticity formed in the pad proximate a peripheral edge of the pad, wherein the pad can be stretched over a top surface of the supporting structure and contract against the supporting structure whereby the pad maintains complete coverage over the top surface of the supporting structure, wherein the supporting structure is a diaper changing table that is pivotably connected to a wall by first and second connecting members, and further wherein the peripheral edge of the pad includes first and second points wherein there is no latent elasticity positioned on the peripheral edge whereby the first point is proximate the first member and the second point is proximate the second member when the pad is positioned on the changing table.

2. A diaper changing pad according to claim 1, wherein the latent elasticity comprises an elastic band.

3. A diaper changing pad according to claim 1, further comprising at least one string connected to the peripheral edge of the pad for tying to the support structure.

4. A diaper changing pad according to claim 1, further comprising first and second pairs of strings connected to the peripheral edge of the pad for tying to the support structure.

5. A diaper changing pad according to claim 1, wherein the latent elasticity is formed continuously along the entire peripheral edge of the pad.

6. A diaper changing pad according to claim 1, further comprising an adhesive positioned at the first and second points for maintaining the pad on the changing table.

7. A diaper changing pad according to claim 6, further comprising a first pair of ties connected to the pad at the first point for tying around the first member, and a second pair of ties connected to the pad at the second point for tying around the second member.

8. A diaper changing pad according to claim 7, wherein the latent elasticity is formed in the first and second longitudinal sides, and the first lateral side.

9. A diaper changing pad according to claim 8, wherein the peripheral edge of the pad includes two points wherein there is no latent elasticity.

10. A diaper changing pad according to claim 1, wherein the pad is rectangular, and has first and second opposed longitudinal sides and first and second opposed lateral sides.

11. A disposable diaper changing pad for positioning on a supporting structure to provide a barrier between the supporting structure and a person positioned on the top surface of the pad, comprising a liquid absorbent material and a latent elasticity formed in the pad proximate a peripheral edge of the pad, wherein the pad can be stretched over a top surface of the supporting structure and contract against the supporting structure whereby the pad maintains complete coverage over the top surface of the supporting structure, wherein the pad is rectangular, and has first and second opposed longitudinal sides and first and second opposed lateral sides, and further wherein the second lateral side is proximate the support structure, and an adhesive is positioned proximate the second lateral side.

12. A diaper changing pad according to claim 11, wherein the latent elasticity is formed continuously along the entire peripheral edge of the pad.

13. A diaper changing pad according to claim 11, wherein the latent elasticity comprises an elastic band.

14. A diaper changing pad according to claim 11, further comprising at least one string connected to the peripheral edge of the pad for tying to the support structure.

15. A diaper changing pad according to claim 11, further comprising first and second pairs of strings connected to the peripheral edge of the pad for tying to the support structure.

16. A diaper changing pad according to claim 11, wherein the supporting structure is a diaper changing table that is pivotably connected to a wall by first and second connecting members, and further wherein the peripheral edge of the pad includes first and second points wherein there is no latent elasticity positioned on the peripheral edge whereby the first point is proximate the first member and the second point is proximate the second member when the pad is positioned on the changing table.

17. A diaper changing pad according to claim 16, further comprising a first pair of ties connected to the pad at the first point for tying around the first member, and a second pair of ties connected to the pad at the second point for tying around the second member.

* * * * *